US009410732B2

(12) United States Patent
Choi et al.

(10) Patent No.: US 9,410,732 B2
(45) Date of Patent: Aug. 9, 2016

(54) REFRIGERATOR

(71) Applicant: LG ELECTRONICS INC., Seoul (KR)

(72) Inventors: Kyukwan Choi, Seoul (KR); Minsub Kim, Seoul (KR); Sungkyong Han, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/606,384

(22) Filed: Jan. 27, 2015

(65) Prior Publication Data

US 2015/0241116 A1 Aug. 27, 2015

(30) Foreign Application Priority Data

Feb. 21, 2014 (KR) ..... 10-2014-0020486

(51) Int. Cl.

*F25D 25/00* (2006.01)
*F25D 23/02* (2006.01)
*E05B 65/00* (2006.01)
(Continued)

(52) U.S. Cl.

CPC ..... *F25D 23/028* (2013.01); *E05B 65/0042* (2013.01); *E06B 7/16* (2013.01); *F25D 23/00* (2013.01); *F25D 23/02* (2013.01); *F25D 23/025* (2013.01); *F25D 25/00* (2013.01)

(58) Field of Classification Search

CPC ..... Y10S 292/71; F25D 25/02; F25D 25/021; F25D 25/022; F25D 23/025; F25D 23/02; F25D 23/028; E06B 7/16; E06B 65/0042
USPC ..... 292/194–196, 219, 220, 221, 223, 227; 312/291, 292, 404, 109, 293.2, 405.1, 312/321.5, 405, 326, 327, 296
See application file for complete search history.

(56) References Cited

U.S. PATENT DOCUMENTS 2,122,680 A * 7/1938 Dart ..... F25D 23/04 126/197
2,129,923 A * 9/1938 Frankel ..... F25D 11/02 126/197
2,131,522 A * 9/1938 Peterson ..... F25D 23/04 126/197

(Continued)

FOREIGN PATENT DOCUMENTS

GB 537114 * 6/1941
JP S 48-056657 U 7/1973

(Continued)

OTHER PUBLICATIONS

European Search Report dated Jun. 26, 2015 for Application No. 15152828.8, 6 pages.

*Primary Examiner* — Janet M Wilkens
(74) *Attorney, Agent, or Firm* — Fish & Richardson P.C.

(57) ABSTRACT

A refrigerator includes a cabinet having a storage compartment and a main door mounted on the cabinet by a hinge and having an access opening. An auxiliary storage compartment is provided at a rear portion of the main door and is accessible through the access opening. A sub door is mounted on the main door and opens and closes the access opening. A locking device selectively couples the main door with the sub door, and a handle is pivotably attached on the sub door and can be pushed rearward by pivoting about an end of the handle. A lock control device is mounted in the sub door and unlocks the locking device as a result of the handle being pushed rearward about the end of the handle. The handle has a gripping recess and opens the main door and the sub door simultaneously as a result of being pulled.

18 Claims, 7 Drawing Sheets

(51) Int. Cl.
*E06B 7/16* (2006.01)
*F25D 23/00* (2006.01)

(56) References Cited

U.S. PATENT DOCUMENTS 2,131,680 A * 9/1938 Zahodiakin ..... F25D 23/04 312/242
2,150,064 A * 3/1939 John ..... F25D 23/04 292/169
2,204,053 A * 6/1940 Dart ..... E05B 65/0042 292/5
2,234,651 A * 3/1941 Pick ..... E05B 5/00 292/126
2005/0200253 A1* 9/2005 Wissinger ..... F25D 23/028 312/405
2009/0179540 A1 7/2009 Seo
2010/0147011 A1 6/2010 Kang
2011/0023527 A1 2/2011 Kwon
2012/0161598 A1 6/2012 Blum
2015/0069900 A1* 3/2015 Lim ..... F25D 23/028 312/405
2015/0137674 A1* 5/2015 Choi ..... F25D 23/04 312/404
2015/0176886 A1* 6/2015 Lee ..... E05C 7/02 312/404

FOREIGN PATENT DOCUMENTS

JP S 56-164495 U 12/1981
JP S 57-085184 U 5/1982
JP 2000-249462 A 9/2000
JP 2001-124463 A 5/2001
KR 10-0165019 9/1998
KR 20-1999-0031602 7/1999
KR 20060020079 * 3/2006
KR 10-2013-0058084 6/2013
WO 2014200316 * 12/2014

* cited by examiner

REFRIGERATOR

CROSS-REFERENCE TO RELATED APPLICATIONS

Pursuant to 35 U.S.C. §119(a), this application claims the benefit of an earlier filing date and right of priority to Korean Patent Application No. 10-2014-0020486, filed on Feb. 21, 2014, the contents of which are incorporated by reference herein in their entirety.

TECHNICAL FIELD

The present application relates to a refrigerator, and more particularly to a refrigerator that facilitates external access to an auxiliary storage compartment provided on a main door of the refrigerator.

BACKGROUND

In general, a refrigerator is an appliance that reduces the interior temperature thereof using cool air generated by a refrigeration cycle including a compressor, a condenser, an expansion valve, and an evaporator to store foods in a frozen state or in a refrigerated state.

A refrigerator generally includes a freezer compartment for storing foods or beverages in a frozen state and a refrigerator compartment for storing foods or beverages at low temperature.

A refrigerator may be classified as a top mount type refrigerator, in which a freezer compartment is disposed above a refrigerator compartment, a bottom freezer type refrigerator, in which a freezer compartment is disposed under a refrigerator compartment, or a side by side type refrigerator, in which a freezer compartment and a refrigerator compartment are partitioned by a partition wall such that the freezer compartment is disposed at the left side of the refrigerator and the refrigerator compartment is disposed at the right side of the refrigerator.

In recent years, the capacity of a refrigerator has been greatly increased. In addition, a door shelf or a receiving case is provided at the inside of a door so as to form a space for receiving stored goods, thereby efficiently utilizing a receiving space of the refrigerator.

SUMMARY

In one aspect, a refrigerator includes a cabinet having a storage compartment and a main door mounted on the cabinet by a hinge and having an access opening. An auxiliary storage compartment is provided at a rear portion of the main door and is accessible through the access opening of the main door. A sub door is mounted on the main door and is configured to open and close the access opening. A locking device is configured to selectively couple the main door with the sub door, and a handle is pivotably attached on the sub door and is configured to be pushed rearward by pivoting about an end of the handle. A lock control device is mounted in the sub door and is configured to unlock the locking device as a result of the handle being pushed rearward about the end of the handle. The handle has a gripping recess and is configured to open the main door and the sub door simultaneously as a result of the handle being pulled.

In some implementations, the locking device includes a catching protrusion that is provided at a coupling groove formed at the main door. The locking device also includes a hook member pivotably mounted at the sub door and protruding from a surface of the sub door and configured to selectively engage with the catching protrusion.

In some implementations, the handle is configured to horizontally pivot about a vertical pivoting shaft mounted at a lower end of the sub door at the end of the handle.

In some implementations, the handle is configured to manipulate the interlocking device to vertically pivot the hook member to release coupling between the hook member and the catching protrusion as a result of a user pushing the handle to horizontally pivot the handle.

In some implementations, the lock control device includes a push rod configured to convert horizontal pivoting motion of the handle into vertical longitudinal motion and transmit the converted vertical longitudinal motion. The lock control device also includes a pivoting member pivotably mounted together with the hook member and configured to vertically pivot as a result of the vertical longitudinal motion of the push rod.

In some implementations, the handle is provided with a protrusion extending upward and having an inclined upper surface configured to upwardly push an inclined bottom surface of the push rod.

In some implementations, the sub door has a guide groove configured to guide and support motion of the lock control device.

In some implementations, the lock control device further includes an elastic member configured to restore the pivoting member to a prior position as a result of force applied from the push rod to the pivoting member to pivot the pivoting member being removed.

In some implementations, the handle is configured such that a front of the handle is substantially co-planar with a front of the sub door.

In some implementations, the main door has a step-shaped part that is located at a lower end of the main door and that has a concave shape defining a handle groove opened downward between the step-shaped part and the handle.

In some implementations, the refrigerator further includes a gasket that is disposed at a rear of the sub door along an edge of the sub door and that is configured to reduce leakage of air as a result of the sub door being coupled to the main door.

In some implementations, the locking device and the lock control device are disposed at an outside of a circumference of the gasket.

In another aspect, a refrigerator includes a cabinet having a storage compartment and a main door mounted on the cabinet by a hinge and having an access opening. An auxiliary storage compartment is provided on the main door and is accessible through the access opening of the main door. A sub door is mounted on the main door and is configured to open and close the access opening. A gasket is provided along an edge of the sub door and is configured to surround the access opening and reduce leakage of air between the sub door and the main door as a result of the sub door being closed. A locking device is provided at an outside of a circumference the gasket of the sub door and is configured to selectively couple the main door with the sub door. A handle is attached on the sub door and is configured to be pushed rearward to release the sub door from the main door. A lock control device is mounted in the sub door, disposed at the outside of the gasket, and is configured to unlock the locking device and release the sub door from the main door as a result of the handle being pushed rearward. The handle is configured to open the main door and the sub door simultaneously as a result of the handle being pulled.

In some implementations, the locking device includes a hook member pivotably mounted at the sub door and protruding from a rear of the sub door, and a catching protrusion provided in a coupling groove formed at a front of the main door and configured to allow a front end of the hook member to be inserted thereinto.

In some implementations, the catching protrusion includes a catching groove formed at a middle portion of a protruding part protruding upward such that the catching groove is engaged with the hook member. The catching protrusion also includes an inclined surface formed at a front of the catching groove and configured to guide the hook member such that the hook member is pivoted and caught in the catching groove as a result of the hook member being inserted into the coupling groove.

In some implementations, the handle is configured to horizontally pivot about a vertical pivoting shaft mounted at a lower end of the sub door at the end of the handle, as a result of the handle being pushed rearward.

In some implementations, the lock control device includes a push rod configured to convert horizontal pivoting motion of the handle into vertical longitudinal motion as a result of the handle being pushed and to transmit the converted vertical longitudinal motion. The lock control device also includes a pivoting member pivotably mounted together with the hook member and configured to vertically pivot as a result of the vertical longitudinal motion of the push rod.

In some implementations, the lock control device further includes a guide groove provided in the sub door configured to guide the vertical longitudinal motion of the push rod.

In some implementations, the lock control device further includes an elastic member configured to restore the pivoting member to a prior position as a result of force applied from the push rod to the pivoting member to pivot the pivoting member being removed.

In some implementations, the handle has a gripping recess and is configured such that a front and a bottom of the handle are substantially co-planar with a front and a bottom of the sub door, respectively, in a restored position of the handle.

It is to be understood that both the foregoing general description and the following detailed description are exemplary and explanatory and are intended to provide further explanation of the invention as claimed.

Figure 1:
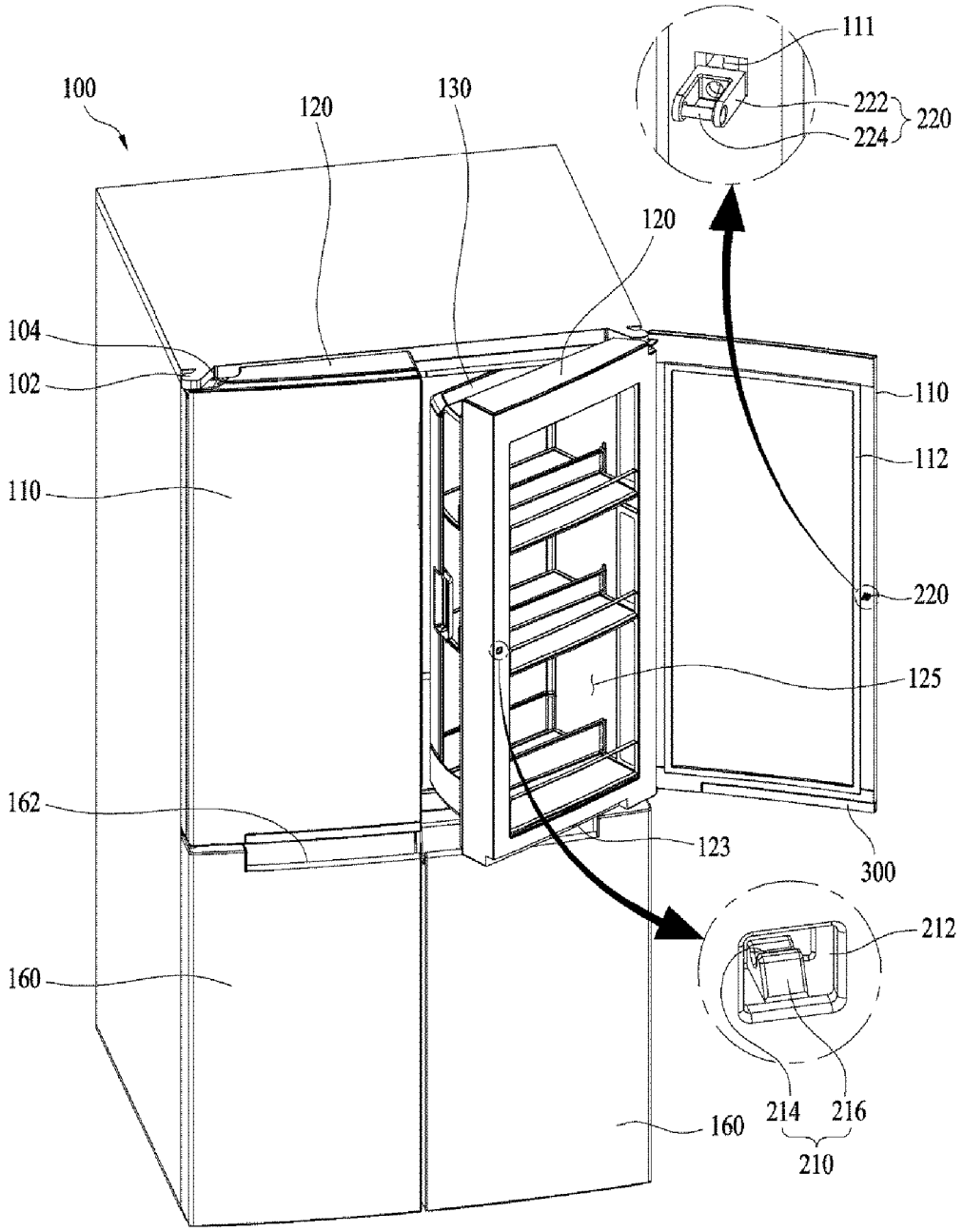
FIG. 1 is a perspective view showing an example of a refrigerator according to some implementations of the present disclosure.

The details of one or more implementations are set forth in the accompanying drawings and the description below. Other features, objects, and advantages of the implementations will be apparent from the description and drawings, and from the claims.

DETAILED DESCRIPTION

A refrigerator compartment may include a main door for opening and closing a storage compartment of the refrigerator, and a sub door pivotably mounted at the main door. The refrigerator may be configured such that a user may open and close the sub door to access an auxiliary storage compartment provided at the inside of the main door through an access opening formed at the main door. The auxiliary storage compartment may, in some implementations, be referred to as a home bar. In some implementations, the sub door may be referred to as a home bar door.

A handle may be provided on the sub door. When the user pulls the handle, the sub door may be opened in a state in which the sub door is coupled to the main door, and both the sub door and the main door may open simultaneously. Consequently, the user may access the refrigerator compartment in a state in which the refrigerator compartment is opened.

In some implementations, the sub door may be selectively opened while the main door remains closed. For example, the sub door may be coupled to the main door through a hook member that is provided at the rear (e.g., an inward-facing portion) of the sub door and a latch device that is provided at the main door.

In some implementations, the coupling between the hook member on the sub door and the latch device on the main door is released by pushing a latch release button provided at the front of the sub door. In such implementations, the latch release button is configured to operate a latch release device for releasing a locked state of the latch device through the sub door.

Further, in such implementations, a though-hole is formed through a front panel of the sub door such that the latch release button extends through the through-hole in a state in which a portion of the latch release button protrudes from the front panel of the sub door. Consequently, the user may push the latch release button such that the latch release device is operated.

However, such latch release buttons typically extend through a middle height part of the sub door with the result that front of the sub door may not provide a sleek and clean appearance. In addition, such implementations may result in a gap between the latch release button and the through hole with the result that, in a case in which foreign matter is caught in the gap between the latch release button and the through-hole, it is difficult to remove the foreign matter.

The present disclosure describes implementations in which a refrigerator is configured to have a structure in which a handle provided on a sub door may be manipulated to selectively maintain or release a coupling between a main door and the sub door. For example, in some implementations, a refrigerator may be configured such that a pulling of the handle opens both the main door and the sub door simultaneously, while a pushing of the handle opens only the sub door, while keeping the main door closed.

FIG. 1 shows an example refrigerator according to some implementations of the present disclosure.

The refrigerator in FIG. 1 includes a cabinet 100 having a storage compartment, a main door 120 mounted on the cabinet by a hinge and having an access opening 125, an auxiliary storage compartment 130 provided at a rear portion of the main door (as illustrated in FIG. 1), a sub door 110 mounted on the main door for opening and configured to close the access opening, a locking device including a catching protrusion 210 and a hook member 220 (e.g., locking device 200 in FIG. 3) configured to selectively couple the main door with the sub door, a handle 300 attached on the sub door and configured to move rearward (towards the interior of the cabinet 100), and a lock control device (e.g., lock control device 400 in FIG. 3) mounted in the sub door and configured to unlock the main door, when the handle 300 is moved rearward (inwards towards the interior of the cabinet 100).

The refrigerator shown in FIG. 1 is a bottom freezer type refrigerator, in which a refrigerator compartment is provided at the upper part of the cabinet 100 and a freezer compartment is provided at the lower part of the cabinet 100.

However, implementations of the present disclosure are not limited to the bottom freezer type refrigerator but may be applied to any refrigerator including a main door and a sub door as doors for opening and closing the storage compartment of the refrigerator.

In the example shown in FIG. 1, a pair of refrigerator compartment doors are pivotably mounted at the right and left sides of the upper part of the cabinet 100 as the doors for opening and closing the refrigerator compartment.

The refrigerator compartment doors may be provided symmetrical to each other.

A refrigerator compartment door includes a main door 120 for opening and closing the refrigerator compartment and a sub door 110 pivotably mounted at the main door 120.

The main door 120 is pivotably mounted at a first hinge 102 provided at one end of the cabinet 100.

The sub door 110 is pivotably mounted at a second hinge 104 provided at the main door 120.

Although the refrigerator includes a pair of refrigerator compartment doors at the right and left sides of the upper part of the cabinet in the drawing, one main door having a width corresponding to that of the cabinet 100 and one sub door having a width corresponding to that of the cabinet 100 may be pivotably mounted at the cabinet 100.

A door for opening and closing the freezer compartment also includes a left side freezer compartment door and a right side freezer compartment door 160. The freezer compartment door may be constituted by one pivotable door or one drawer type door movable forward and backward.

The freezer compartment door 160 may be provided at the upper end thereof with a handle groove 162 configured such that a user can pull the freezer compartment door while holding the handle groove to open the freezer compartment door.

The refrigerator compartment main door 120 is provided at the middle part thereof with an opening 125. The refrigerator compartment main door 120 is provided with an auxiliary storage compartment 130 at the rear portion of the main door (as illustrated in FIG. 1). The sub door 110 opens and closes the opening 125 such that the user can access the auxiliary storage compartment 130.

The handle 300 may be horizontally mounted at the lower part of the main door 120. In some implementations, the handle 300 may be configured to horizontally pivot about one end of the handle when the other end is pushed.

The handle 300 may release the locking device 200 when the handle 300 is pivoted backward about a vertical pivoting shaft vertically provided at one side end thereof.

The locking device 200 includes a catching protrusion 210 provided in a coupling groove 212 formed at one side of the front of the main door 120 and a hook member 220 protruding from one side of the rear of the sub door 110 (e.g., a side of the sub door 110 that faces inwards towards main door 120 when the sub door 110 is closed) and pivotably mounted at a horizontal pivoting shaft such that the hook member 220 is selectively engaged with the catching protrusion 210.

The coupling groove 212 may be formed such that the front end of the hook member 220 can be inserted into the coupling groove 212 and the catching protrusion 210 may be formed such that the catching protrusion 210 is directed upward in the coupling groove 212.

As shown in an enlarged view of FIG. 1, the catching protrusion 210 may include a catching groove 214 formed at the middle of a protruding part protruding upward such that the catching groove 214 is engaged with the hook member 220 and an inclined surface 216 formed at the front of the catching groove 214 for guiding the hook member 220 such that the hook member 220 is pivoted when the hook member 220 is inserted into the coupling groove 212.

The hook member 220 may be pivoted upward with respect to the sub door 110 such that engagement between the hook member 220 and the catching protrusion 210 is released.

The hook member 220 may extend from a horizontal pivoting shaft mounted in the sub door 110 such that the hook member 220 is formed in a bracket shape.

As shown in another enlarged view of FIG. 1, the sub door 110 is provided with a hole 111 at the rear of the sub door 110, through which the hook member 220 pivotably extends.

The hook member 220 may include a pair of extension parts 222 from the horizontal pivoting shaft mounted in the sub door 110 to the rear of the sub door 110 and a catching pin 224 coupled between opposite ends of the extension parts 222.

For this reason, the hook member 220 is provided with a through hole, which is formed among the horizontal pivoting shaft, the extension parts 222, and the catching pin 224 such that the catching protrusion 210 is inserted through the through hole.

Meanwhile, the sub door 110 is provided at the inner side thereof with a gasket 112 for sealing a gap defined between the sub door 110 and the main door 120 when the sub door 110 is closed to contact the front of the main door 120 to prevent leakage of cool air through the gap.

The gasket 112 is disposed along the edge of the sub door 110. The gasket 112 is formed such that the gasket 112 is slightly larger than the opening 125 provided at the middle part of the main door 120. For example, in some implementations, the gasket may surround a circumference of the access opening, an example of which is shown in FIG. 1.

In some implementations, as in the example shown in FIG. 1, the locking device 200 may be provided at an outside of the circumference of the gasket 112 (when viewed from the front of the refrigerator). As such, this may further help prevent leakage of air through the gasket 112.

Figure 2:
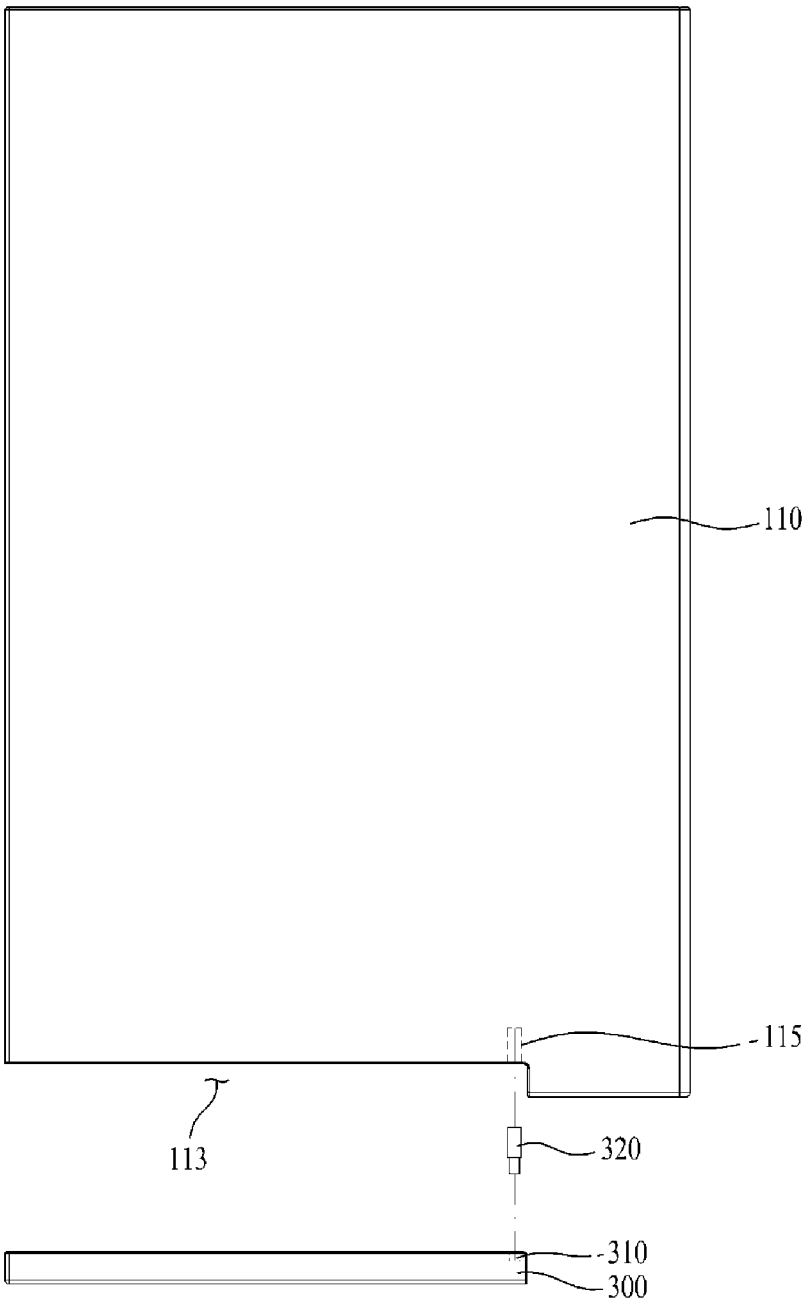
FIG. 2 is an exploded view showing examples of a sub door and a handle.

FIG. 2 shows an example of the sub door and the handle.

The sub door 110 is provided at the lower end thereof with a step part 113 formed in a shape corresponding to the handle 300 such that the handle 300 can be mounted at the step part.

A pivoting shaft groove 115, into which a vertical pivoting shaft 320 provided at one side end of the handle 300 is inserted, may be provided at the ceiling of the step part 113 at a lower end of the sub door.

The vertical pivoting shaft 320 may be mounted in a shaft hole 310 formed at the upper side of one end of the handle 300. As such, the handle 300 is configured to rotate along a horizontal plane about the vertical pivoting shaft 320 positioned at one end of the handle 300, such that the other end of the handle 300 engages or disengages from a lock control device that unlocks the locking device 200.

In some implementations, the shaft hole 310 may be formed in the shape of a through hole and a fastening member may be fastened to the vertical pivoting shaft 320 through the through hole.

Figure 3:
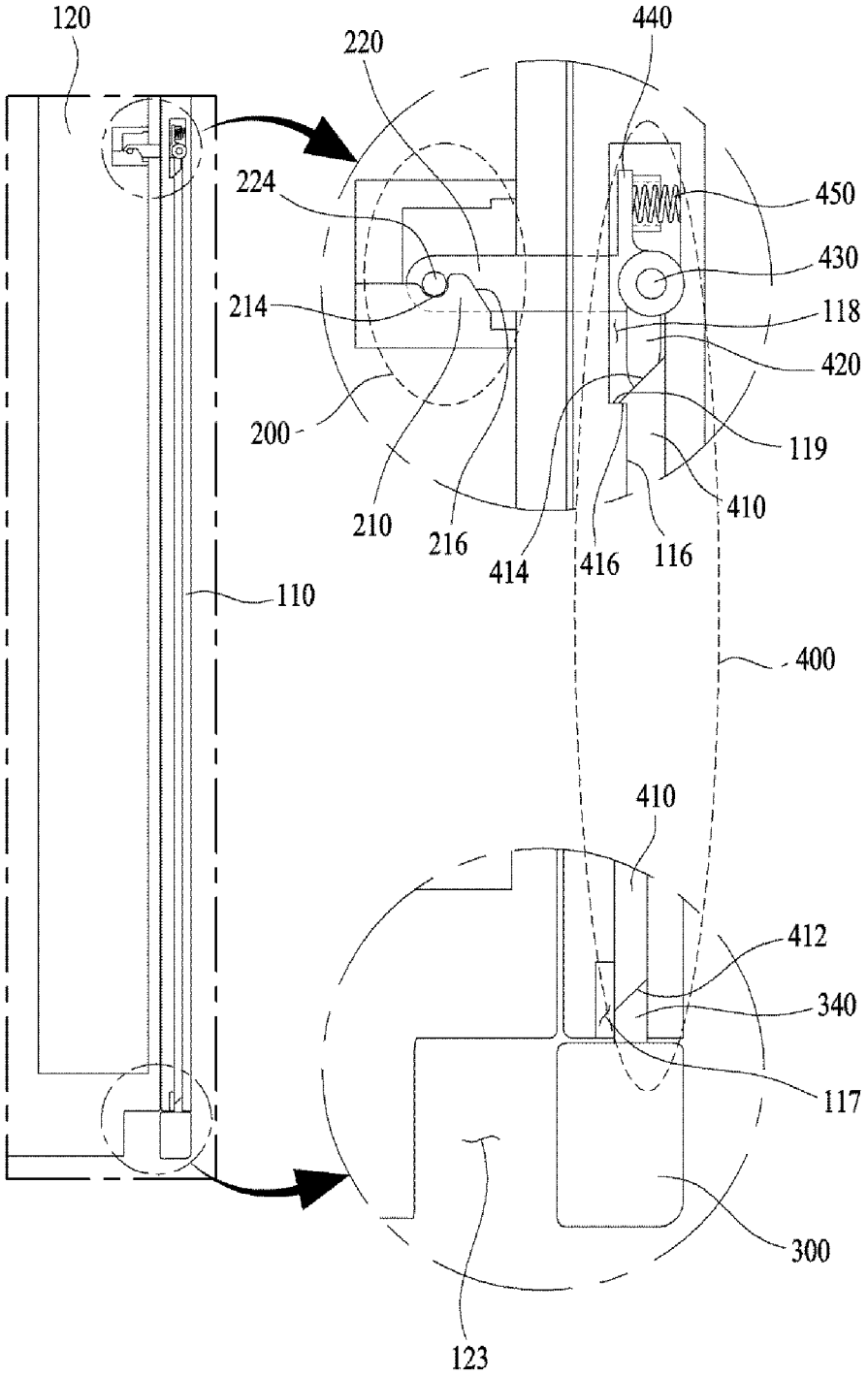
FIG. 3 is a sectional view showing examples of the handle, a lock control device, and a locking device provided at the sub door.

FIG. 3 is a sectional view showing the handle, the lock control device 400 (including a pivoting member 420 and a push rod 410), and the locking device 200 (including the catching protrusion 210 and the hook member 220) provided at the sub door.

The lock control device 400 is connected between the locking device 200 and the handle 300 and is configured to transmit a force that is applied to the handle 300 to the locking device 200 to allow the sub door 110 to be released from the main door 120. For example, the lock control device 400 is configured to transmit a pushing (e.g., pivoting) force of the handle 300 that is directed in a first direction (e.g., rearward towards the inside of the cabinet 100) to the hook member 220 of the locking device 200 for pivoting the hook member 220 in a second direction (e.g., upward).

The handle 300 mounted at the lower end of the sub door 110 may be configured such that the front of the handle is substantially co-planar with (e.g., has the same surface plane as) the front of the sub door 110.

At ordinary times, therefore, the sub door 110 has no parts protruding or depressed from the front thereof, thereby providing a sleek and clean appearance.

In addition, the main door 120 may be provided at the lower end thereof with a step part formed in a shape corresponding to the handle 300.

The step part forms a handle groove 123 together with the handle 300 such that a user can insert a finger into the handle groove 123 to pull the handle 300.

Figure 4:
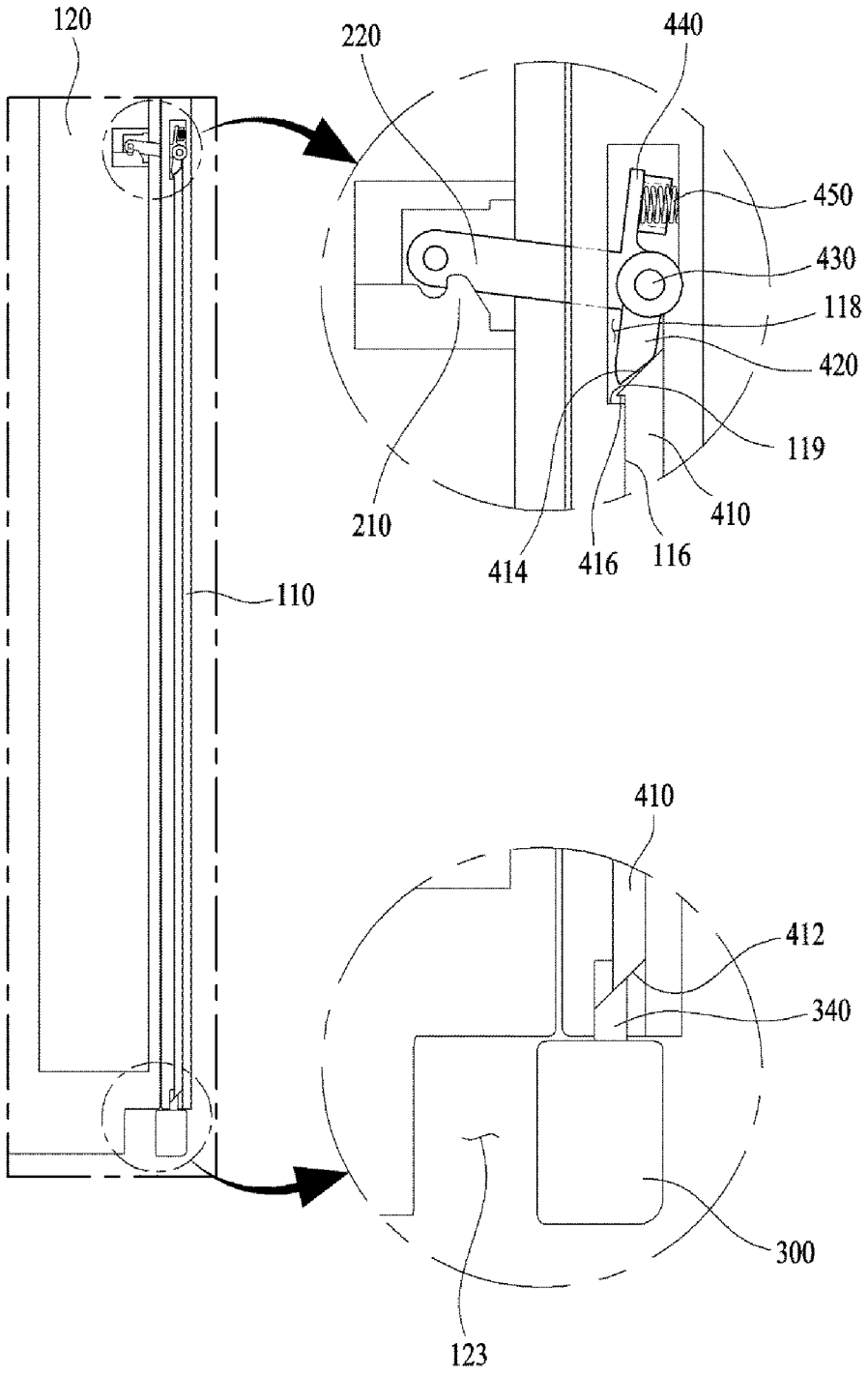
FIG. 4 is a sectional view showing an example of a state in which the handle is pivoted to operate the lock control device and, therefore, the locking device is released.
Figure 5:
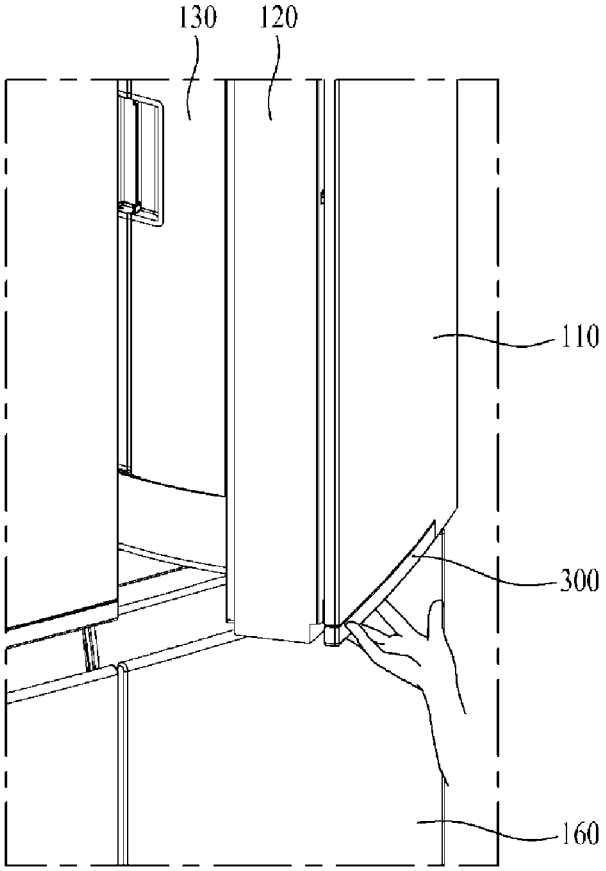
FIG. 5 is a perspective view showing an example in which a user pulls the handle to simultaneously open a main door and the sub door.

The handle 300 may be provided with a protrusion 340 that protrudes upwards from the top of the handle 300, as illustrated in FIGS. 3 and 4. In some implementations, the protrusion 340 may be located at an end of the handle 300 opposite to the end of the handle that is pivotably attached to the vertical pivoting shaft 320 of FIG. 2.

The sub door 110 is provided at the inside thereof with a push rod 410, which is disposed on the handle 300 such that the push rod 410 can move upward and downward.

The lock control device 400 may further include a guide groove 116 provided in the sub door 120 configured to guide the vertical motion of the push rod 410. The push rod 410 is inserted and mounted in the guide groove 116 formed in the sub door 110.

The push rod 410 extends from the vicinity of the lower end of the sub door 110 to a middle height of the sub door 110 at which the hook member 220 is mounted.

As a result, the push rod 410 converts horizontal motion of the handle 300 into vertical motion and transmits the converted vertical motion.

The protrusion 340 may extend upward and the top of the protrusion 340 may be inclined.

Correspondingly, a bottom 412 of the push rod 410 is inclined.

When the user pushes the handle 300, therefore, the protrusion 340 pushes the push rod 410 upward.

The guide groove 116 may be provided at the lower part thereof with a support groove 117 having a width greater than the thickness of the protrusion 340 but less than twice the thickness of the protrusion 340.

The protrusion 340 may be supported by the front of the support groove 117 such that the protrusion 340 can be pivoted until the protrusion 340 is supported by the rear of the support groove 117.

In the sub door 110, a pivoting member 420 is pivotably mounted on the push rod 410.

A top 414 of the push rod 410 may be inclined. Correspondingly, the bottom of the pivoting member 420 may be inclined.

The push rod 410 may be provided at one side end of the inclined top thereof with a protruding part 416 supported by a lower end projection 119 of a pivoting groove 118 provided in the sub door.

The protruding part 416 may be supported such that the push rod 410, vertically mounted in the guide groove 116 of the sub door 110 in an extending state, cannot move downward any more at the lowest position thereof and thus pushing force due to gravity is not applied to the protrusion 340.

The pivoting member 420 may extend downward from a horizontal pivoting shaft 430 that is horizontally mounted in the pivoting groove 118.

The pivoting groove 118 may have a predetermined size enabling the pivoting member 420 to pivot.

As shown in FIG. 3, the rear of the lower part of the pivoting member 420 may be formed in a curved shape such that the rear of the lower part of the pivoting member 420 does not interfere with the pivoting groove 118 when the pivoting member 420 pivots in the pivoting groove 118.

In addition, the front of the lower part of the pivoting member 420 may be formed in a round shape such that the front of the lower part of the pivoting member 420 softly contacts the top of the push rod 410 when the pivoting member 420 pivots.

The lock control device 400 may further include an elastic member 450 for restoring the pivoting member.

The elastic member 450 may be a compression spring mounted between one inner side of the pivoting groove 118 and an extension part 440 extending upward from the horizontal pivoting shaft 430.

The extension part 440 may be provided at one side thereof with a groove for receiving a portion of the elastic member 450.

The elastic member 450 maintains a state in which the hook member 220 is caught by the catching protrusion 210 unless the user pivots the handle 300 to pivot the hook member 220 upward.

As shown in FIG. 1, in some examples, the hook member 220 constituting the locking device 200 may be disposed at the outside of a circumference of the gasket 112 when the sub door 110 is viewed from the front.

In addition, the pivoting member 420 and the push rod 410 constituting the lock control device 400 form operating the hook member 220 and the protrusion 340 of the handle may be disposed at the outside of a circumference of the gasket 112.

In such implementations in which the locking device 200, the handle 300, and the lock control device 400 for performing coupling or separation between the main door 120 and the sub door 110 are disposed at the outside of a circumference of the gasket 112 as described above, it is possible to prevent leakage of cool air therethrough.

Hereinafter, the operation of the refrigerator according to some implementations of the present disclosure will be described with reference to FIGS. 3 to 7.

When the user pulls the handle while inserting a finger into the handle groove 123, the sub door 110 and the main door 120 are simultaneously pivoted and opened in a state in which the sub door 110 and the main door 120 are coupled to each other.

In this case, the hook member 220 is engaged with the catching protrusion 210 as shown in FIG. 3. When the handle 300 of the sub door 110 is pulled, therefore, the main door 120 is also pulled.

One end of the handle 300 is supported by the vertical pivoting shaft 320. At the other end of the handle 300, the protrusion 340 is supported by the front of the support groove 117.

When the handle 300 is pulled, therefore, the handle 300 is not pivoted relative to the sub door 110, resulting in the handle 300 being pulled together with the sub door.

Figure 6:
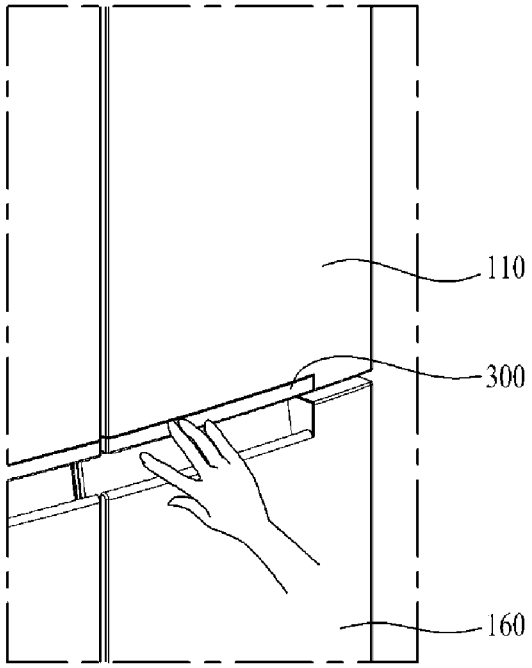
FIG. 6 is a perspective view showing an example in which the user pushes the handle of the door, which is in a closed state, to release the locking device.

Subsequently, when the user pushes the handle 300 (to pivot the handle 300 about the vertical pivot 320 in FIG. 2) as shown in FIG. 6, a locked state in which the hook member 220 is caught by the catching protrusion 210 as shown in FIG. 4 is released with the result that the sub door 110 is separated from the main door 120.

At this time, the protrusion 340, which is pivoted together with the handle 300, pushes the push rod 410 upward. The push rod 410 pivots the pivoting member 420, whereby the hook member 220 is also pivoted and moved upward.

As a result, the hook member 220 is disengaged from the catching protrusion 210 and is then separated from the catching groove 214 and, therefore, the sub door 110 may be separated from the main door 120.

Figure 7:
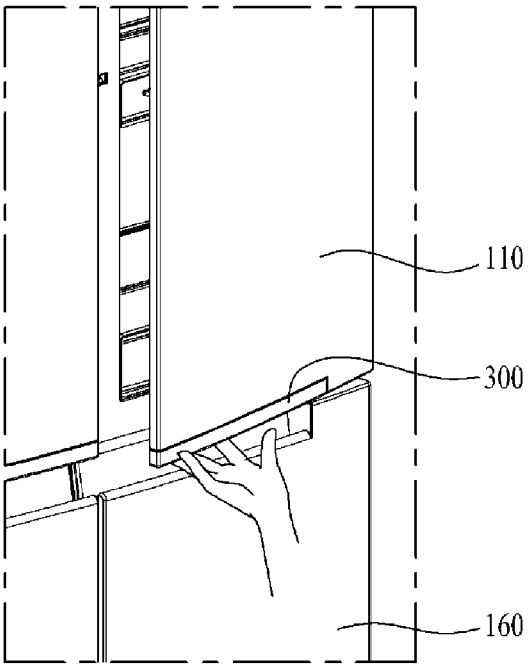
FIG. 7 is a perspective view showing an example in which the user releases the locking device and then pulls the handle to open only the sub door.

Subsequently, when the user pulls the handle 300 as shown in FIG. 7, only the sub door 110 is opened.

At this time, the hook member 220 is pivoted in the opposite direction by the elastic member 450 and then repivots to the original position thereof.

In order to separate the sub door 110 from the main door 120, in some implementations, the user pushes the handle 300 to release a state in which the hook member 220 is caught by the catching protrusion 210.

When the handle 300 is pushed, therefore, the sub door 110 may be slightly spaced apart from the main door 120.

To this end, a repulsion member (not shown) including rubber or a spring may be provided at the rear of the sub door 110 (e.g., a part of the sub door 110 that faces inwards towards main door 120 when the sub door 110 is closed).

The repulsion member may prevent the hook member 220 from being caught by the catching protrusion 210 again due to the elastic member 450 when the user releases his/her hand after the user pushes the handle 300.

As is apparent from the above description, the refrigerator according to some examples of the present disclosure has an effect in that the handle for selectively releasing coupling between the main door and the sub door is provided at the lower end of the sub door, whereby the front of the sub door provides a sleek and clean appearance.

In addition, the refrigerator according to some implementations of the present disclosure has an effect in that the handle may be utilized as a decorative element of the sub door.

Furthermore, the refrigerator according to some implementations of the present disclosure has an effect in that the handle provided at the lower end of the sub door is operated through the lock control device mounted in the sub door, whereby it is possible to release the locking device provided at the middle height of the sub door.

It will be apparent that modifications and variations can be made from the disclosed examples while remaining true to the implementations described. Thus, it is intended that the described implementations include modifications and variations of the disclosed examples.

What is claimed is:

1. A refrigerator comprising:

a cabinet having a storage compartment;

a main door mounted on the cabinet by a hinge and having an access opening;

an auxiliary storage compartment provided at a rear portion of the main door and accessible through the access opening of the main door;

a sub door mounted on the main door and configured to open and close the access opening;

a locking device configured to selectively couple the main door with the sub door, the locking device including:

a catching protrusion provided at a coupling groove formed at the main door, and a hook member pivotably mounted at the sub door and protruding from a surface of the sub door and configured to selectively engage with the catching protrusion;

a handle pivotably attached on the sub door and configured to be pushed rearward by pivoting about an end of the handle; and a lock control device mounted in the sub door and configured to unlock the locking device as a result of the handle being pushed rearward about the end of the handle, wherein the handle has a gripping recess and is configured to horizontally pivot about a vertical pivoting shaft mounted at a lower end of the sub door at the end of the handle, and configured to open the main door and the sub door simultaneously as a result of the handle being pulled.

2. The refrigerator according to claim 1, wherein the handle is configured to manipulate the interlocking device to vertically pivot the hook member to release coupling between the hook member and the catching protrusion as a result of a user pushing the handle to horizontally pivot the handle.

3. The refrigerator according to claim 1, wherein the lock control device comprises:

a push rod configured to convert horizontal pivoting motion of the handle into vertical longitudinal motion and transmit the converted vertical longitudinal motion; and a pivoting member pivotably mounted together with the hook member and configured to vertically pivot as a result of the vertical longitudinal motion of the push rod.

4. The refrigerator according to claim 3, wherein the handle is provided with a protrusion extending upward and having an inclined upper surface configured to upwardly push an inclined bottom surface of the push rod.

5. The refrigerator according to claim 4, wherein the sub door has a guide groove configured to guide and support motion of the lock control device.

6. The refrigerator according to claim 3, wherein the lock control device further comprises an elastic member configured to restore the pivoting member to a prior position as a result of force applied from the push rod to the pivoting member to pivot the pivoting member being removed.

7. The refrigerator according to claim 1, wherein the handle is configured such that a front of the handle is substantially co-planar with a front of the sub door.

8. The refrigerator according to claim 7, wherein the main door has a step-shaped part that is located at a lower end of the main door and that has a concave shape defining a handle groove opened downward between the step-shaped part and the handle.

9. The refrigerator according to claim 1, further comprising a gasket that is disposed at a rear of the sub door along an edge of the sub door and that is configured to reduce leakage of air as a result of the sub door being coupled to the main door.

10. The refrigerator according to claim 9, wherein the locking device and the lock control device are disposed at an outside of a circumference of the gasket.

11. A refrigerator comprising:

a cabinet having a storage compartment;

a main door mounted on the cabinet by a hinge and having an access opening;

an auxiliary storage compartment provided on the main door and accessible through the access opening of the main door;

a sub door mounted on the main door and configured to open and close the access opening;

a gasket provided along an edge of the sub door and configured to surround the access opening and reduce leakage of air between the sub door and the main door as a result of the sub door being closed;

a locking device provided at an outside of a circumference the gasket of the sub door and configured to selectively couple the main door with the sub door;

a handle attached on the sub door and configured to be pushed rearward to release the sub door from the main door; and a lock control device mounted in the sub door, disposed at the outside of the gasket, and configured to unlock the locking device and release the sub door from the main door as a result of the handle being pushed rearward, wherein the handle is configured to open the main door and the sub door simultaneously as a result of the handle being pulled.

12. The refrigerator according to claim 11, wherein the locking device comprises:

a hook member pivotably mounted at the sub door and protruding from a rear of the sub door; and a catching protrusion provided in a coupling groove formed at a front of the main door and configured to allow a front end of the hook member to be inserted thereinto.

13. The refrigerator according to claim 12, wherein the catching protrusion comprises:

a catching groove formed at a middle portion of a protruding part protruding upward such that the catching groove is engaged with the hook member; and an inclined surface formed at a front of the catching groove and configured to guide the hook member such that the hook member is pivoted and caught in the catching groove as a result of the hook member being inserted into the coupling groove.

14. The refrigerator according to claim 12, wherein the lock control device comprises:

a push rod configured to convert horizontal pivoting motion of the handle into vertical longitudinal motion as a result of the handle being pushed and to transmit the converted vertical longitudinal motion; and a pivoting member pivotably mounted together with the hook member and configured to vertically pivot as a result of the vertical longitudinal motion of the push rod.

15. The refrigerator according to claim 14, wherein the lock control device further comprises a guide groove provided in the sub door configured to guide the vertical longitudinal motion of the push rod.

16. The refrigerator according to claim 15, wherein the lock control device further comprises an elastic member configured to restore the pivoting member to a prior position as a result of force applied from the push rod to the pivoting member to pivot the pivoting member being removed.

17. The refrigerator according to claim 11, wherein the handle is configured to horizontally pivot about a vertical pivoting shaft mounted at a lower end of the sub door at the end of the handle, as a result of the handle being pushed rearward.

18. The refrigerator according to claim 11, wherein the handle has a gripping recess and is configured such that a front and a bottom of the handle are substantially co-planar with a front and a bottom of the sub door, respectively, in a restored position of the handle.

* * * * *